US006701809B2

(12) United States Patent
Huang

(10) Patent No.: US 6,701,809 B2
(45) Date of Patent: Mar. 9, 2004

(54) EXPANDABLE MAGNETIC SOCKET WRENCH CONNECTOR DEVICE

(76) Inventor: Chun Po Huang, No. 41, Lane 120, Wenshinnan 3rd Rd., Nantuen Chiu, Taiching (TW), 408

( * ) Notice: Subject to any disclaimer, the term of this patent is extended or adjusted under 35 U.S.C. 154(b) by 43 days.

(21) Appl. No.: 10/139,226

(22) Filed: May 7, 2002

(65) Prior Publication Data

US 2003/0209112 A1 Nov. 13, 2003

(51) Int. Cl.[7] ..... B25B 13/06
(52) U.S. Cl. ..... 81/125; 81/180.1; 81/900; 403/DIG. 1
(58) Field of Search ..... 81/125, 180.1, 81/185.2, 900, 437–439; 403/DIG. 1; 294/65.5

(56) References Cited

U.S. PATENT DOCUMENTS 2,624,223 A * 1/1953 Clark ..... 81/125
3,207,010 A * 9/1965 Wending ..... 81/125
5,146,814 A * 9/1992 Vasichek ..... 81/125
5,163,345 A * 11/1992 Doan et al. ..... 81/125
2003/0041698 A1 * 3/2003 Chi ..... 81/125

* cited by examiner

*Primary Examiner*—D. S. Meislin
(74) *Attorney, Agent, or Firm*—Rosenberg, Klein & Lee

(57) ABSTRACT

A elastic magnetic socket wrench connector device which contains: first tube with first magnet fixed at first end and an inward stop around second end; and second tube sliding through the second end with one end inside said first tube, the inside end has a flange and with second magnet fixed at outside end; said inward stop preventing said flange from sliding off said first tube and the first magnet and said second magnet are of the same magnetic poles. The first magnet has stronger magnetic force than that of said second magnet. The device can attract a bolt preventing from it fall to the ground and the length of the device can be adjusted to fit different kinds of socket wrenches and sockets.

7 Claims, 5 Drawing Sheets

EXPANDABLE MAGNETIC SOCKET WRENCH CONNECTOR DEVICE

TECHNICAL FIELD

This invention relates generally to a magnetic socket wrench connector device, in particular, to provide an improved magnetic socket wrench connector device capable of adjusting its length to fit all kinds of socket wrenches.

BACKGROUND OF THE INVENTION

Socket wrenches, also referred to as ratchet wrenches, have a rectangular drive to rotate a socket, which engages a nut or bolt head causing it to rotate. A plurality of sockets is used, each socket having a different size opening to fit a different size nut or bolt. The drive for all the sockets is the same. Generally the sockets are stored separate from the wrench.

To tighten a bolt, a user has to use one hand to hold the wrench engaged with a socket and use another hand to insert the bolt into the socket then start tightens it to the desired position. Using a socket wrench to loose a bolt, a user use one hand to handle the wrench and when the bolt is loosened, the user has to use another hand to take it out or to catch it before it fall to the ground. During the process of tighten or loose a bolt, a user usually will hold something that is fixed to ground or wall to support his body with one hand and use the other hand to do the work of tightening or loosening the bolt. It's not convenient for a user to do so many things when he is tightening or loosening a bolt. Especially for those who only have one arm, it's difficult to handle the socket wrench and at the same time pay attention not to let the bolt fall out.

One related art to overcome this problem is a magnetic socket wrench connector device shown in FIG. 5. The device 60 contains the concave portion 61 at one end to engage with the spur 61 of the socket wrench 70 and at the other end. There is a protruding portion 62 to engage with the socket 80. The protruding portion can extend through the end of the socket 80 and into the concave portion 81. The magnet 63 is attached to the front face of the protruding portion 62. When the bolt 90 is set in to the concave portion, the magnet 63 can attract the head 91 the bolt 90. When the bolt is loosened, the head 91 of the bolt will still be attracted by the magnet 63, so the bolt 90 will not fall out. Therefore, A user can use the wrench 70 with only one hand.

However, The wrench 70 has the following disadvantages: 1. The manufacture of the device 60 is complicated and the cost is high. In order to fit with different sockets with different specifications, the device 60 has to comply with different socket wrenches and sockets and each device 60 has a magnet 63 attached to it, so it's complicated. 2. The size of the device 60 is big and inconvenient to operate it. The length of the protruding portion 62 is fixed, so when the device 60 is used with smaller sockets, the protruding portion 62 that extend into the concave portion 81 will be longer than the use needs and therefore, a head of the bolt 90 may not be fully inserted into the concave portion 81. On the other side, when the device 60 is used with a larger socket 80, the protruding portion 62 that extend into the concave portion 81 will be too short and the magnet 63 cannot fully contact the bolt 90. The magnet then cannot catch the bolt 90 securely.

What we need is a kind device that not only can attract bolts but also the length is adjustable to fit different kinds of socket wrenches and sockets and at the same time it's easy to manufacture and the cost is low.

SUMMARY OF INVENTION

It is therefore a primary objective of the present invention to provide a socket wrench connector device, which can attract the bolts and its length is adjustable to fit different socket wrenches and sockets.

Another object of the present invention is to provide a socket wrench connector device to be easily manufactured and the cost is comparatively low.

The present invention, briefly summarized, in one embodiment discloses a elastic magnetic socket wrench connector device, which contains: first tube with first magnet fixed at first end and an inward stop around second end; second tube sliding through the second end with one end inside the first tube, the inside end has a flange and with second magnet fixed at outside end; The inward stop preventing the flange from sliding off the first tube and the first magnet and the second magnet are of the same magnetic poles. The first magnet has stronger magnetic force than that of said second magnet. The cross sections of the first tube and the second tube can be circular or rectangular. The first magnet and the second magnet are fixed inside the first tube and second tube or attached at one end of each tube.

BRIEF DESCRIPTION OF DRAWINGS

The invention will be more clearly understood after refer to the following detailed description read in conjunction with the drawings wherein.

DETAILED DESCRIPTION OF PREFERRED EMBODIMENTS

Figure 1:
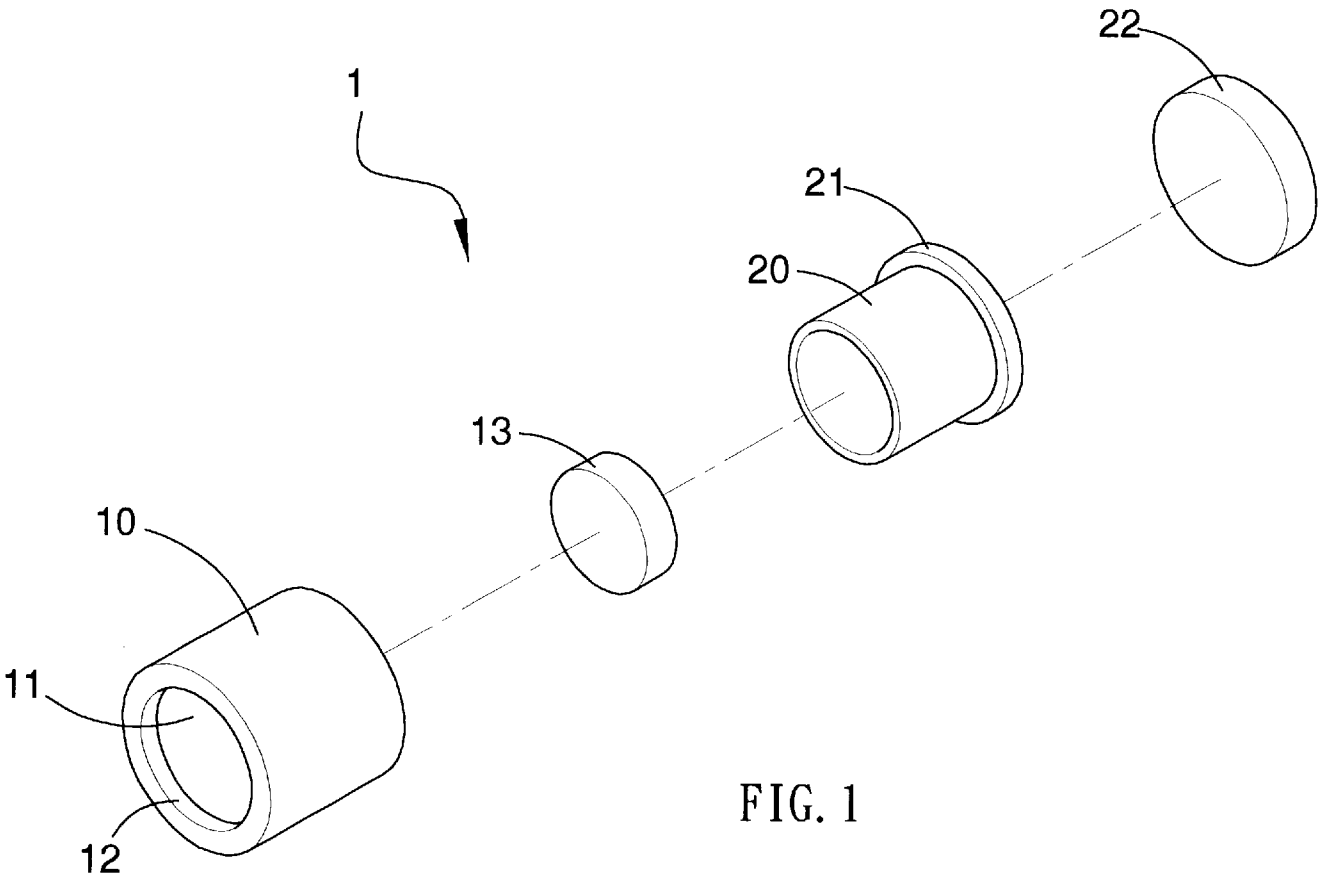
FIG. 1 is a exploded perspective view of the embodiment.
Figure 2:
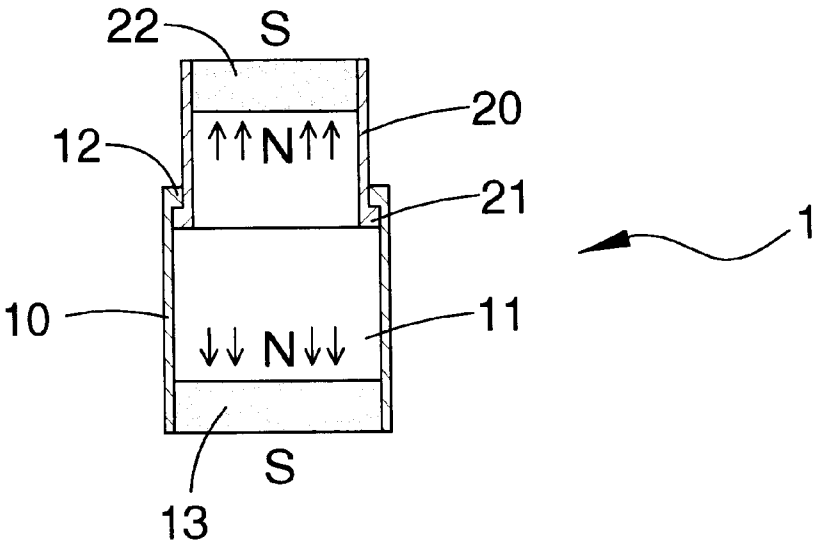
FIG. 2 is a cross section view of the embodiment.

With reference to FIG. 1 and FIG. 2 of the drawings, reference numeral 1 refers generally to a elastic magnetic socket wrench connector device of the first preferred embodiment of the invention, which contains: first tube 10 with first magnet 13 fixed at first end and an inward stop 12 around second end; second tube 20 sliding through the second end with one end along the channel 11 inside the first tube 10, the inside end has a flange 21 and with second magnet 22 fixed at outside end; The inward stop 12 preventing said flange from sliding off said first tube 10 and said first magnet 13 and said second magnet 22 are of the same magnetic poles. The first magnet 13 has stronger magnetic force than that of said second magnet 22. If the material of the magnets 13 and 22 are the same and obviously the first tube 10 is bigger than the second tube 20, so the first magnet 13 will be bigger than the second magnet 22 and the magnetic force of the first magnet 13 will be stronger than that of the second magnet 22.

Since the magnetic poles of the first magnet 13 and the second magnet 22 are same, for example, they are of the N-type poles; they will reject each other. The two magnets 13 and 22 are fixed in the opposite side of the tubes, so the tubes 10 and 20 will be pushed to the opposite direction.

Figure 3:
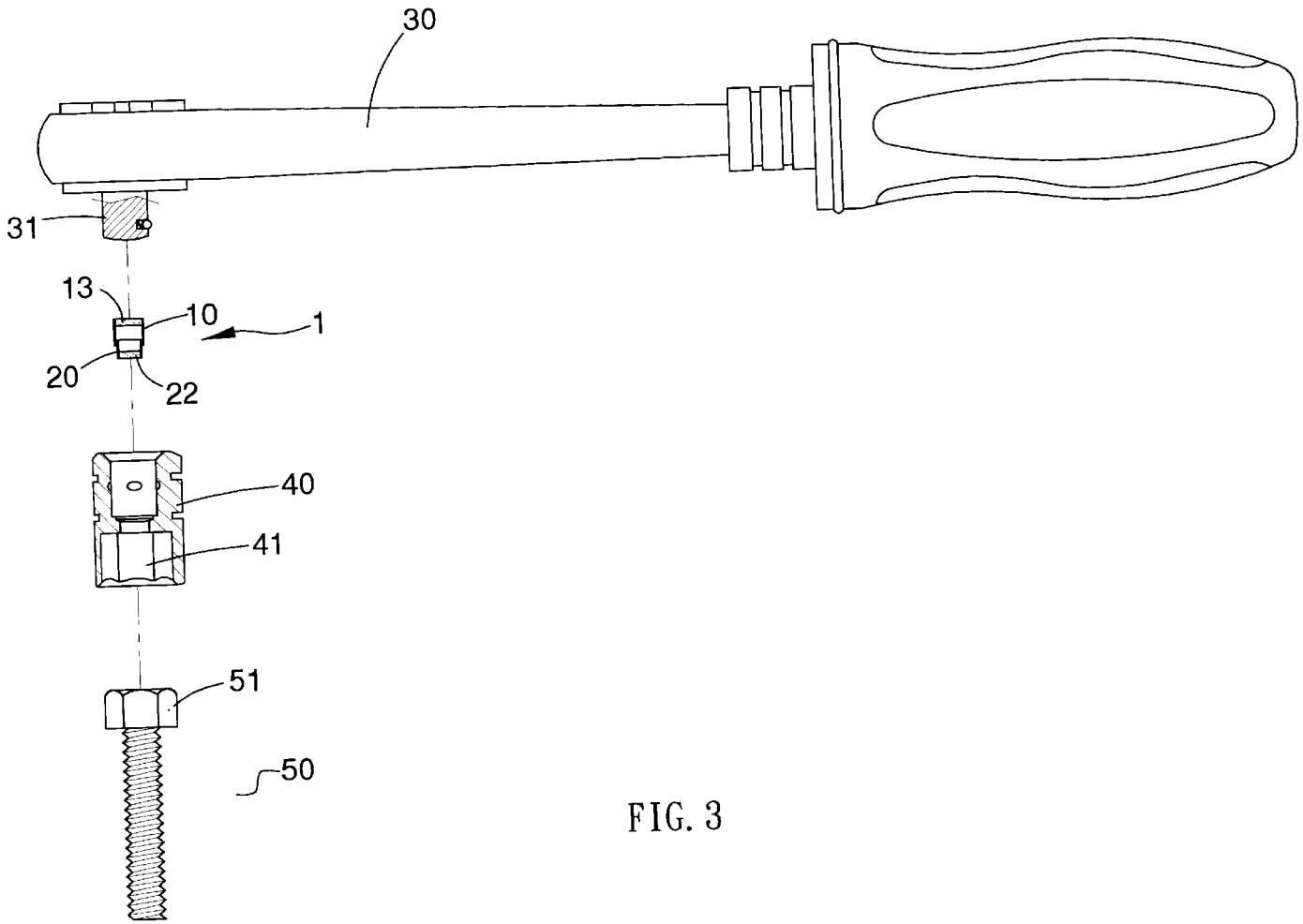
FIG. 3 is a perspective view of the embodiment illustrating its use with a conventional socket wrench and bolt.
Figure 4:
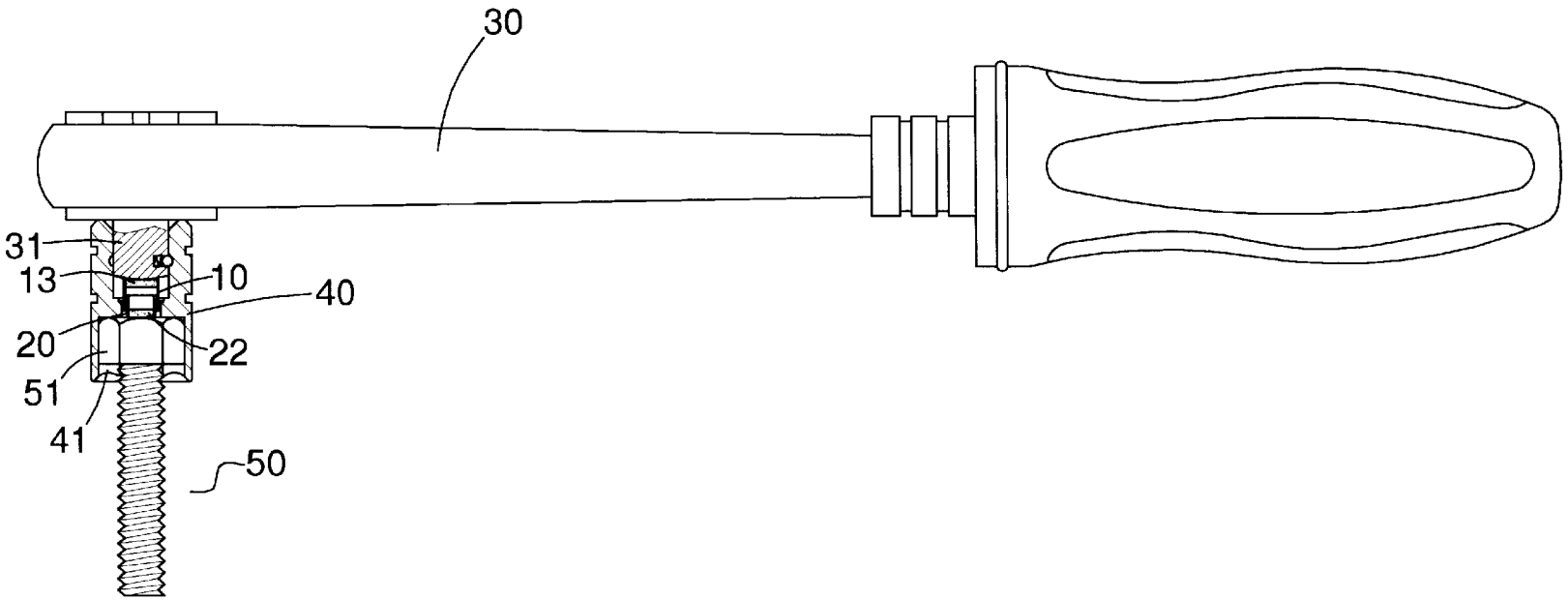
FIG. 4 is a cross section view of the embodiment illustrating its use with a conventional socket wrench and bolt.
Figure 5:
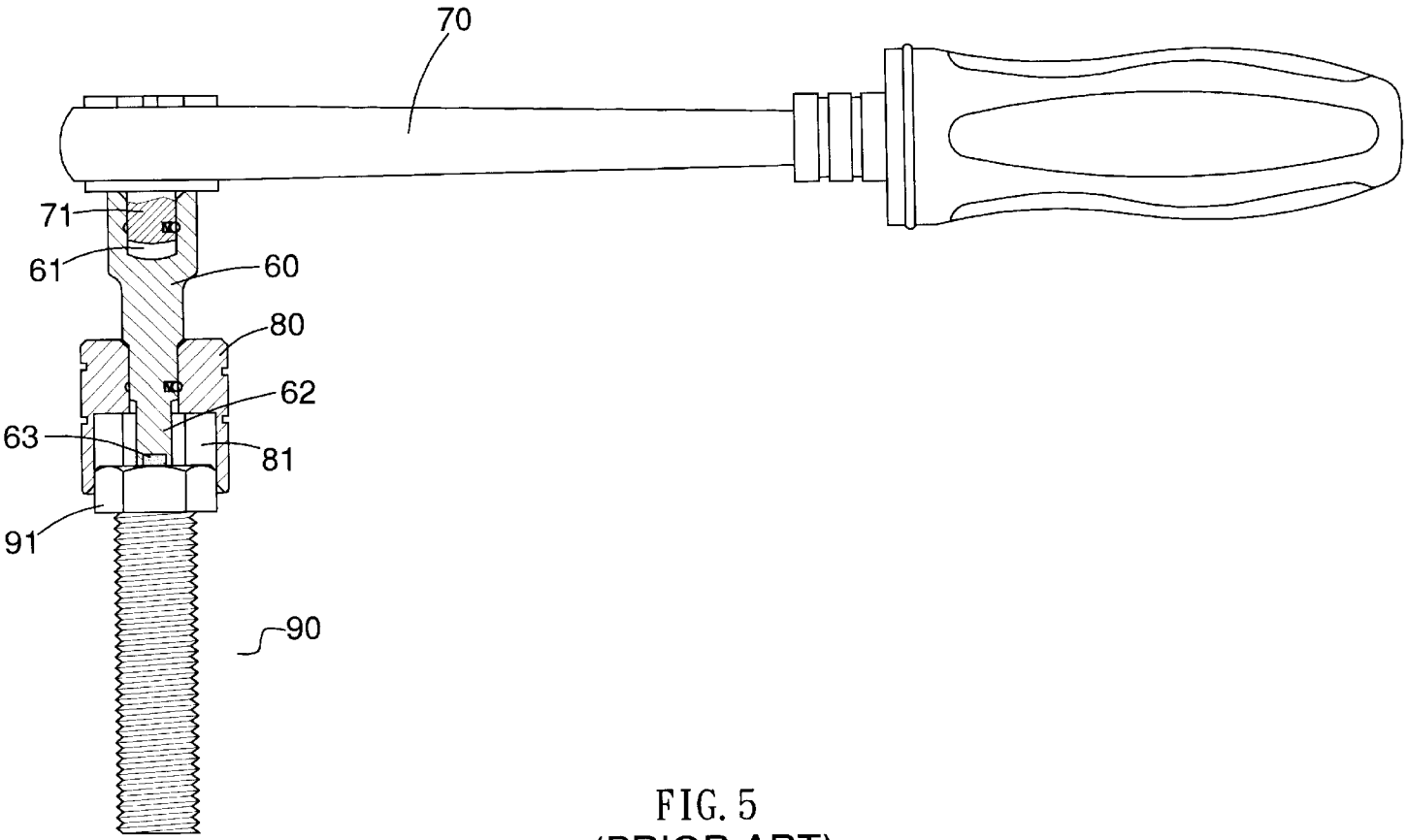
FIG. 5 (PRIOR ART)
FIG. 5 is a perspective view of a related art illustrating its use with a conventional socket wrench and bolt.

With reference to FIG. 3 and FIG. 4 of the drawings, the first magnet 13 is attracted to the spur 31 of the socket wrench 30 and the second magnet 22 is extended through the end of the socket 40 and into the concave portion 41 of the socket 40. The head 51 of the bolt 50 is attracted to the second magnet 22 inside the concave portion 41. Because the magnetic force of the first magnet 13 is stronger than the second magnet 22, when the user takes the bolt 50 out of the socket 40, the elastic magnetic socket wrench connector device 1 will not be taken out with the bolt 50.

If the user presses both ends of the tubes 10 and 20, the second tube 20 can slide along the channel 11 of the first tube 10 and if the user releases the tubes 10 and 20, the length of the device 1 will increase because the two magnets 13 and 22 with the same magnetic poles will reject each other. Therefore the length of the device 1 can be adjusted to fit different kinds of socket wrenches and sockets.

When the length between the two magnets is short, the reject force is strong and when the length of the two magnets is long, the reject force become small. It's like a spring or an elastic object.

In order to securely attract the bolt 50 and the spur 31, Magnets 13 and 22 is preferably a high strength magnet, such as neodymium-iron-boron. As shown in FIG. 1 and FIG. 2, the device 1 has a small size and simple structure. It's easy to make and inexpensive to manufacture.

Numerous characteristics and advantages of the invention have been set forth in the foregoing description, together with details of the structure and function of the invention, and the novel features thereof are pointed out in appended claims. The disclosure, however, is illustrated only, and changes may be made in detail, especially, in matters of shape, size and arrangement of parts, materials and the combination thereof within the principle of the invention, to the full extend indicated by the broad general meaning of the terms in which the appended claims are expressed.

I claim:

1. An expandable magnetic socket wrench connector device comprising:

a first tube with a first magnet fixed at a first end and an inward stop around a second end; and a second tube sliding through said second end with one end inside said first tube, said inside end having a flange, a second magnet being fixed at an outside end of said second tube, said inward stop preventing said flange from sliding off said first tube, and said first magnet and said second magnet being of the same magnetic poles.

2. The device of claim 1, wherein said first magnet has stronger magnetic force than said second magnet.

3. The device of claim 1, wherein said first tube and said second tube have rectangular cross sections.

4. The device claim 1, wherein said first tube and said second tube have circular cross sections.

5. The device of claim 1, wherein said first magnet is fixed inside said first end.

6. The device of claim 1, wherein said second magnet is fixed inside said outside end.

7. The device of claim 1, wherein said first and second magnets are high strength magnets.

* * * * *